US006128901A

United States Patent [19]

Sha

[11] Patent Number: 6,128,901

[45] Date of Patent: Oct. 10, 2000

[54] PRESSURE CONTROL SYSTEM TO IMPROVE POWER PLANT EFFICIENCY

[76] Inventor: William T. Sha, 2823 Meyers Rd., Oak Brook, Ill. 60523

[21] Appl. No.: 09/431,112

[22] Filed: Nov. 1, 1999

[51] Int. Cl.[7] ..... B60T 13/20; F04C 19/00

[52] U.S. Cl. ..... 60/557; 60/661; 417/68

[58] Field of Search ..... 60/651, 661; 417/68; 62/100; 165/302

[56] References Cited

U.S. PATENT DOCUMENTS

| | | | |
|---|---|---|---|
| 1,372,926 | 3/1921 | Audouin . | |
| 1,373,463 | 4/1921 | Suczek . | |
| 1,523,456 | 1/1925 | Suczek . | |
| 4,272,962 | 6/1981 | Viscovich et al. | 60/648 |
| 4,359,313 | 11/1982 | Bernard | 417/68 |
| 4,390,058 | 6/1983 | Katsumato et al. | 165/1 |
| 4,958,679 | 9/1990 | Drosedziok et al. | 165/13 |
| 5,005,351 | 4/1991 | Archer | 60/651 X |
| 5,366,348 | 11/1994 | Skelton | 417/68 |

OTHER PUBLICATIONS

Anson, D., Available of Fossil–Fired Steam Power Plants, Electric Power Research Institute Report, EPRI FP–422–SR, Jun. 1977, Table 1–5.

VanKuiken, J.C, et al, Replacement Energy Costs for Nuclear Electricity–Generating Units in the United States: 1997–2001, NUREG/CR–4012, ANL–AA–30, vol. 4, Sep. 1997, Table 6.

Piskorowski, J, et al, Condenser Performance Test and Back–Pressure Improvement, Electric Power Research Institute Report, EPRI CS–5729, Apr. 1988, Report Summary.

Installation, Operation, and Maintenance, Nash Condenser Exhaust Unit Size AT–1004E, AT–1006, Nash Engineering Company, Bulletin No. 795–B, Chapter 2.

Chien. T.H., et al, COMMIX–PPC: A Three–Dimensional Transient Multicomponent Computer Program for Analyzing Performance of Power Plant Condensers, Vols. I and II, Argonne National Laboratory Report ANL 92–2, 1997, Executive Summary.

*Primary Examiner*—William Wayner
*Attorney, Agent, or Firm*—Philip H. Kier

[57] ABSTRACT

A system for improving the efficiency of a modem power plant for generating electricity with a water-cooled shell and tube steam condenser with an air removal system is disclosed. An air removal system typically includes an air offtake pipe and a two-stage liquid ring vacuum pump. The operating pressure of this type of air removal system under steady state operation attains equilibrium by itself and cannot be changed. This invention adds a pressure control system to lower the operating pressure at the inlet of the vacuum pump of the air removal system so that an optimum minimum pressure is attained to reduce air inventory inside the condenser. This enhances heat transfer and improves power plant efficiency. The pressure control system contains a pressure control device (e.g. miniature condenser), a chiller, and a pump with variable speed. These components are connected in a loop that circulates cold water. Part of the steam in the steam-air mixture from the condenser is condensed while passing through the pressure control device. The pressure control system adjusts the condensation rate in the pressure control device to yield the optimum minimum pressure. The condensation rate is changed by adjusting either the flow rate or the temperature of water leaving the chiller and flowing to the pressure control device, or by adjusting both.

7 Claims, 3 Drawing Sheets

PRESSURE CONTROL SYSTEM TO IMPROVE POWER PLANT EFFICIENCY

BACKGROUND

This invention relates to power plants for generating electricity. More specifically, it pertains to a pressure control system for improving power plant performance by reducing air inventory and increasing overall heat transfer in the power plant's condenser and thus lowering back pressure to a low pressure turbine. The pressure control system is incorporated into the condenser's air removal system, which contains a two-stage liquid ring vacuum pump so that the operating pressure at the inlet of the vacuum pump can be controlled to optimize the condenser's performance.

A condenser is an essential but also largely neglected component in a power plant for generating electricity. In a 1977 report of the Electric Power Research Institute (EPRI), Anson estimates (1) that the loss of large fossil power plant availability directly attributable to condenser problems is 3.8%; and (2) condenser performance can significantly affect heat rate and generation capacity. In a 1988 EPRI report, Piskovsky, et al, estimate that a 3377 pascal (one inch of mercury) increase in back pressure could result in a 2% reduction in generation capacity. Also, excessive air or cooling water leakage in the condenser of fossil power plants can cause premature boiler tube failure and degradation of any component coming into contact with the condensate and feedwater, such as feedwater heaters and turbines. Such leakage is known to cause damage in steam generators for pressurized water reactors in the form of denting, stress corrosion cracking and corrosion fatigue. The cost to repair or replace damaged components and the financial loss as a result of the inability to produce power during an outage are substantial, for example, in a 1997 report of the Argonne National Laboratory, J. C. Van Kuiken, et. al, estimate that the replacement energy cost for a short term outage of 1000 megawatt nuclear power plant is in the range of several hundred thousand dollars per day.

The design of condensers has been based on an empirical, or black box, method without requiring any knowledge of distributions of velocity, pressure, temperature, air concentration, and condensation rate. The approach of condenser manufacturers has been to oversize heat transfer area. As it has long been known that excess air in the condenser degrades heat transfer and increases back pressure, an efficient air removal system is essential to condenser performance. There was very little theoretical work done for improving condenser design and essentially no attempt to optimize condenser performance. However, there are substantial economic benefits from improving condensers and recently the electric utility industry has paid increasing attention to improving condenser performance, design, and reliability. To improve condenser performance, design and reliability, it is necessary to understand detailed velocity, pressure, temperature, air concentration, and condensation rate distributions throughout a condenser, as well as to properly design an air removal system. Owing to significant advances in computer technology, detailed velocity, pressure, temperature, air concentration and condensation rate distributions can now be computed with codes such as COMMIX-PPC developed by Chien et al of Argonne National laboratory in 1997 and a scientific approach or method can be used to optimize condenser design including the condenser's air removal system, which is viewed as one of the boundary conditions for the condenser.

In most modem power plants, the air removal system typically includes an offtake pipe, or pipes, a two-stage, liquid ring vacuum pump (TSLRVP), a vacuum pump seal water heat exchanger, and a vent. Air, a non-condensable gas, mixed with steam pass through the air offtake pipe to the TSLRVP. Some power plants have an air removal system that uses an ejector. However, the performance of air removal systems with injectors under overload conditions for non-condensable gases are recognized as being inferior to the performance of air removal systems with a TSLRVP. As power plants are aging, more air leakage into condenser will occur due to foundation settling, vibration, thermal cycling and creep providing mechanisms for leak propagation . . . etc. The current trend in the power industry is to select an air removal system with a TSLRVP in new power plants and to replace an ejector by a TSLRVP in air removal systems in existing power plants.

To facilitate removal of air from a condenser, an air offtake pipe within a tube bundle should be located in the lowest pressure zone in the shell side of a condenser. If the air offtake pipe is not located in the lowest pressure zone in the shell side, air pockets will be formed in the tube bundles in the condenser leading to an increase in air inventory, a reduction in overall heat transfer, and thus to an increase in back pressure. This is evident by observing the operating pressure of a condenser, which in general is much higher than the corresponding pressure specified in the condenser performance curve. Reducing the size of air pockets or eliminating air pockets inside a condenser will decrease the air inventory, improve condenser performance and increase power plant efficiency. The logical approach for reducing air inventory is to lower pressure at the air offtake pipe to facilitate removal of air by the air removal system.

The prior art recognizes that spraying cold water into the inlet port of a TSLRVP condenses steam in the steam and air mixture from the condenser reduces the volume of gas mixture to be handled by the vacuum pump. This method is used to increase the capacity of the vacuum pump as stated in Bulletin No. 795-B of the NASH Engineering Co. 1988 and is not used to decrease pressure at the inlet of TSLRVP. Audouin in U.S. Pat. No. 1,372,926 uses an auxiliary condenser to remove a large amount of steam from a condenser to reduce its operating pressure. However, the auxiliary condenser is relatively large and requires an additional pump. The instant invention reduces the operating pressure of a condenser by facilitating removal of air from the condenser, rather than by removing a large amount of steam from the condenser.

SUMMARY OF THE INVENTION

The instant invention is a pressure control system to lower the operating pressure and to enhance the air removal capability of a conventional air removal system that uses a two-stage liquid ring vacuum pump. The operating pressure of the conventional air removal system under steady state operation attains equilibrium by itself and cannot be changed. The pressure control system contains a pressure control device, a pump with variable speed, and a chiller to form a cold water loop. Pressure sensors and temperature sensors are installed at various locations. Readings of these sensors are provided to controllers, which are used for controlling either of flow rate or temperature of water, or both, leaving the chiller and flowing to the pressure control device. The pressure control device is essentially a miniature condenser, which could be either a shell and tube type or a type that sprays cold water. The chiller may be any of several conventional types, such as a mechanical shell and tube cooler of the refrigerant evaporative type. The pressure control system is part of the condenser's air removal system and is located at the air offtake pipe external to the condenser before the TSLRVP. The flow rate of steam and air mixture from a condenser to the pressure control device would be expected to be the design value of venting equipment capacity recommended by the Heat Exchange Institute (HEI). The part of steam of the mixture is condensed while the mixture is passing through the pressure control device and then exits to TSLRVP. The operating pressure of the pressure control device is controlled by its condensation rate and should be kept to the optimum minimum, that is, to the pressure that yields optimum performance of the condenser and consequently optimum power output. The optimum minimum pressure can be achieved by adjusting either the flow rate or the temperature of water, or both, from the chiller to the pressure control device manually or automatically. The sole function of the pressure control system is to maintain the optimum minimum pressure in the pressure control device. When this is done, the pressure in an air offtake pipe located in the tube bundle may become the lowest pressure or closer to the lowest pressure in the shell side of the condenser. From calculated results of detailed velocity, pressure, temperature, air concentration, and condensation rate distributions throughout a condenser, it has been found that most of the air pockets are located in the vicinity of the air offtake pipe. Adding the pressure control system of this invention to the conventional air removal systems facilitates removal of air from the condenser. The result is to reduce air inventory inside a condenser, and thereby enhance overall heat transfer, decrease back pressure, and improve power plant efficiency.

DETAILED DESCRIPTION OF INVENTION

Figure 1:
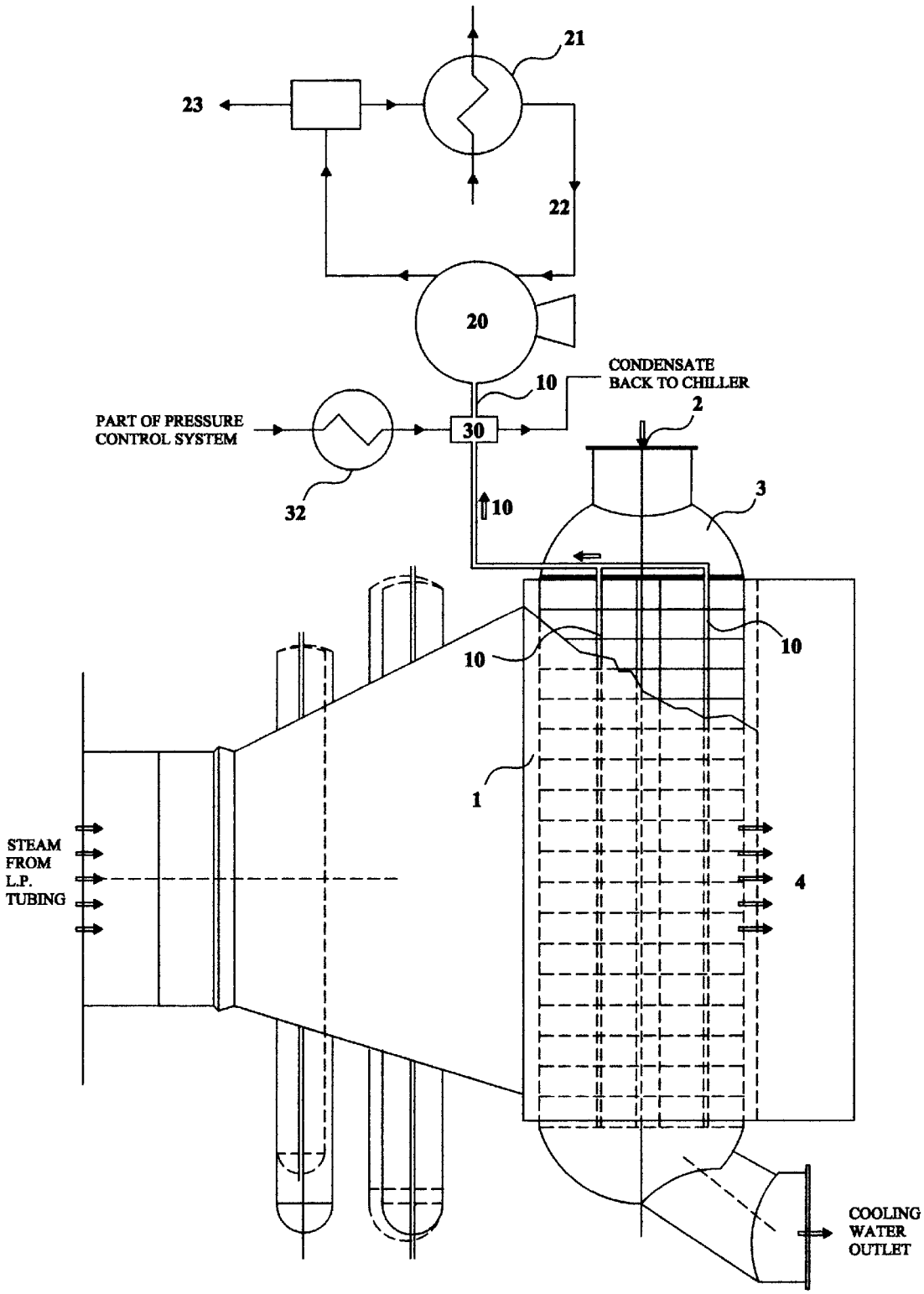
FIG. 1 is a schematic view of a condenser with an air removal system.
Figure 2:
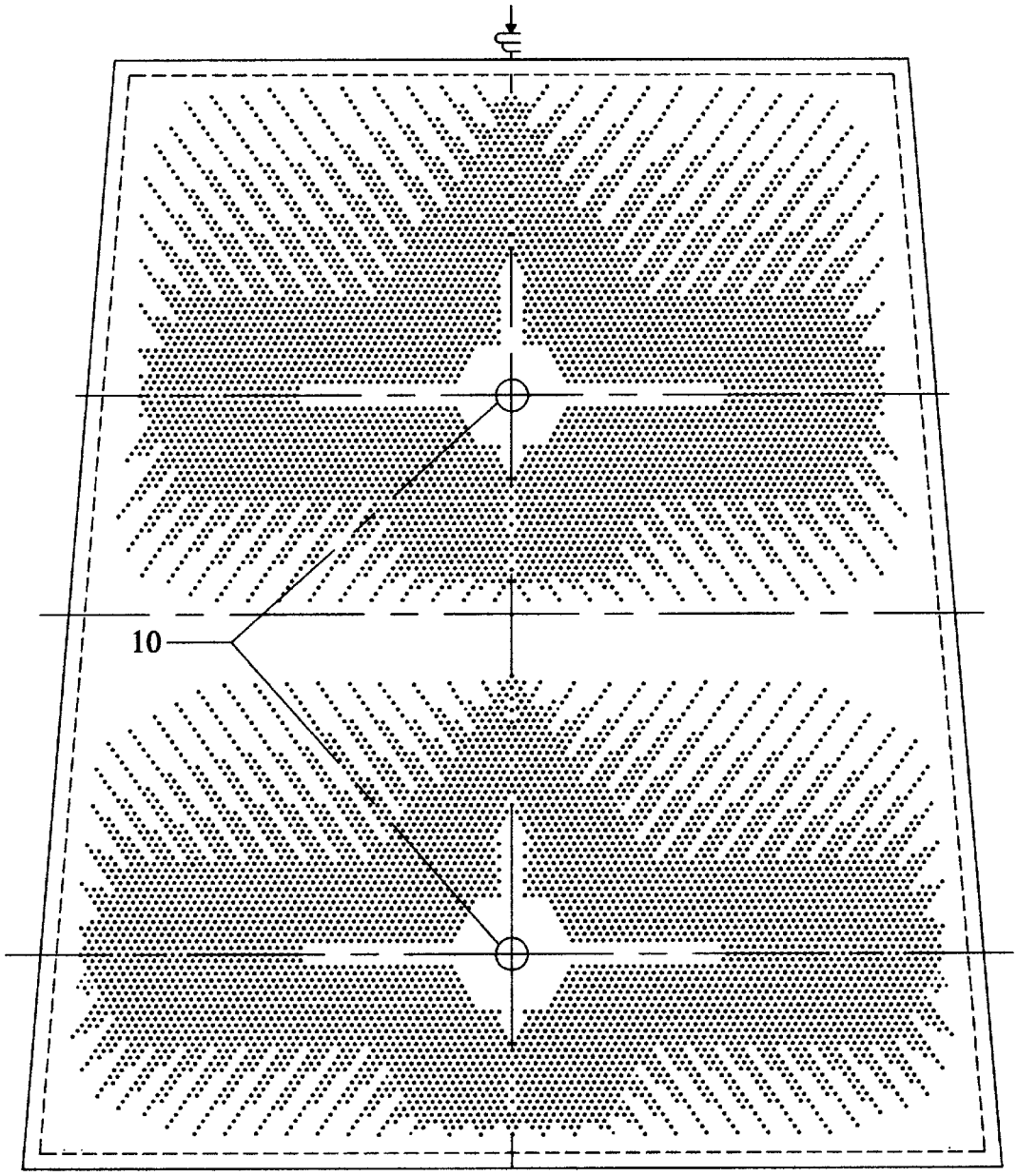
FIG. 2 is a cross section view of a tube bundle in the condenser of FIG. 1 at line 1—1

FIG. 1 shows the parts of a power plant of interest. Steam from a low pressure turbine enters a tube and shell condenser through the steam inlet 1 at the top of the condenser and is distributed throughout the shell side. Cooling water is pumped through water inlet 2 in the inlet water box 3 and is distributed throughout the tubes in the tube bundles. Most (~99.9%) of the steam flowing downward condenses as it contacts the cold surface of the tubes that contain the cooling water. The remainder (~0.1%) of the steam entering the condenser leaves through an air removal system described below. The condensate leaves the condenser through the condensate outlet 4 to go to the hot well. Since, condensers operate at nearly vacuum pressure, air inevitable leaks into the condenser through various penetrations and cracks of the condenser enclosure. The presence of excess air, a non-condensable gas, degrades condenser performance. Therefore, the part of air offtake pipes 10, as shown in FIG. 2, located between tube sheets at both ends of tube bundle are perforated, so that air inside the condenser can be removed via the air removal system. The remaining portion of air offtake pipe 10 is shown in FIG. 1. For clarity a portion of the condenser as shown in FIG. 1 is broken away to show interior part of air offtake pipes which form an integral part of air removal system.

Figure 3:
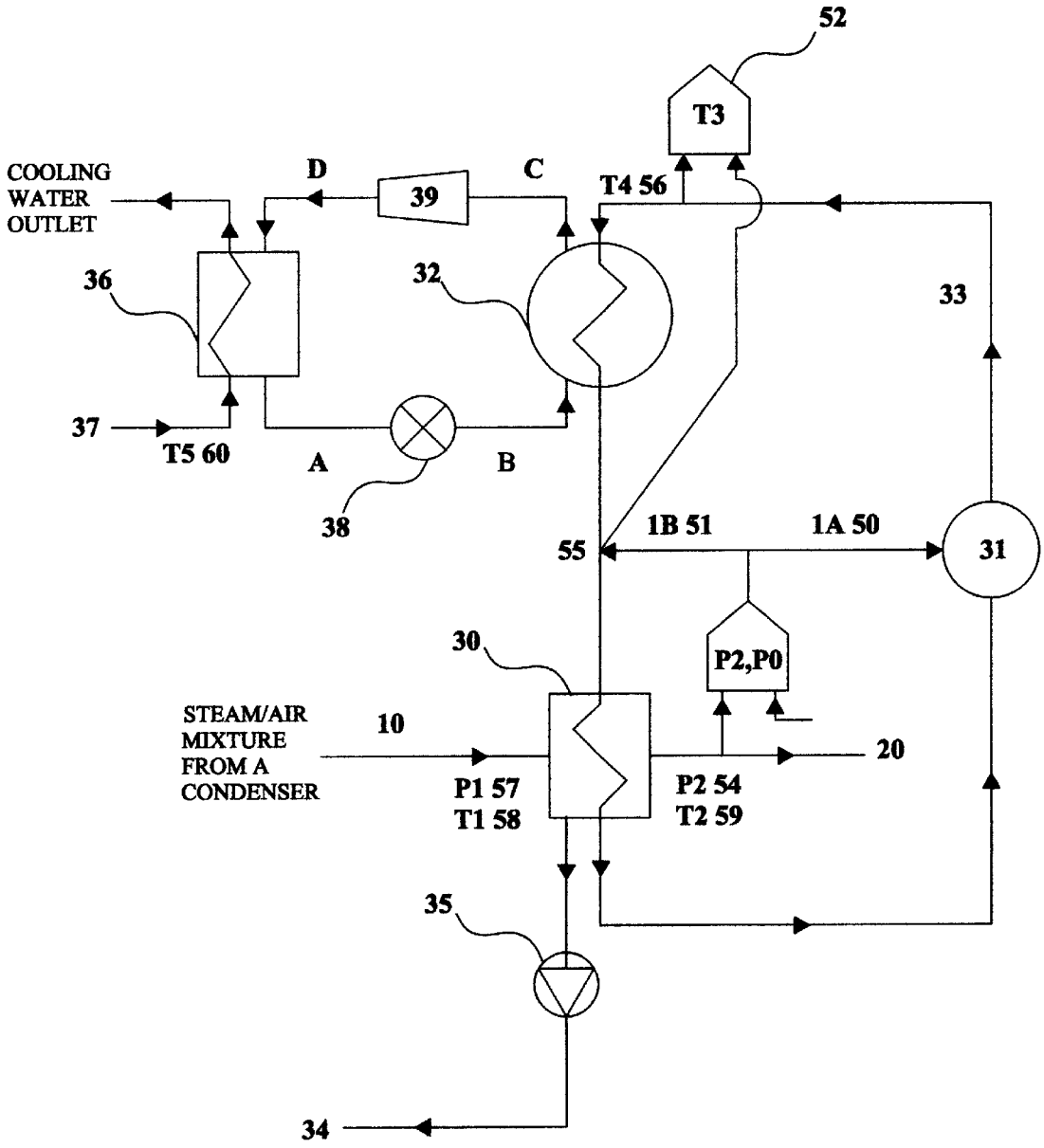
FIG. 3 is a schematic diagram of a pressure control system.

In a conventional air removal system, the air offtake pipe external to the condenser goes directly to the inlet of a TSLRVP 20, which includes a vacuum pump seal water heat exchanger 21 with seal water in its tube side and cooling water 22 in its shell side, and a vent 23 that releases air. The operating pressure under steady state operation at the inlet of the TSLRVP attains an equilibrium by itself and cannot be adjusted. The addition of the pressure control system to the conventional air removal system as shown in FIG. 1 allows the operating pressure at the entry to the TSLRVP to be controlled so that it can be optimized. As shown in FIG. 3, the pressure control system contains a pressure control device 30, a variable speed pump 31, and a chiller 32 connected together by a cold water loop 33. In the cold water loop, flow is from the chiller to the pressure control device. There is a drain line 34 with a check valve 35 to carry condensate from the pressure control device to the low pressure exhaust line of TSLRVP. The check valve is to prevent the condensate returning to the pressure control device. The pressure control system also includes several pressure sensors 57 and 54 and temperatures sensors 58, 59, 55, 56 and 60. The pressure control device is essentially a miniature condenser, which could be either of the shell and tube type or a type that sprays cold water. The design of the pressure control device can readily be carried out with the current practice employed in the power industry, taking into the consideration (1) flow rate of mixture of steam and air from a condenser to the pressure control device, (2) both flow rate and temperature of the cold water leaving the chiller and going to the pressure control device and (3) size and shape of the pressure control device for easy installation and transportation. For a modem power plant for generating electricity, the volume of the pressure control device is estimated to have a volume of less than one cubic meter. The mixture of steam and air from the condenser enters the pressure control device via the air offtake pipe and its steam content is partly condensed before it enters the TSLRVP. The condensation rate in the pressure control device affects the pressure at the entry to the TSLRVP; the greater the condensation rate, the lower this pressure. The condensation rate is controlled manually or automatically by either varying the flow rate or the temperature of water flowing from the chiller to the pressure control device or varying both. The speed of pump 31 is directly proportional to the flow rate in the cold water loop and the pump should be sized to handle a wide range of steam and air mixtures passing through the pressure control device from the condenser. The chiller may be of any conventional type with an automatic control of the exit temperature of water being chilled. One type of conventional chiller, shown in FIG. 3. has a refrigeration cycle with a refrigeration condenser 36 with cooling water inlet 37, a constant enthalpy throttle valve 38 and a compressor with a step controller 39. The refrigeration cycle begins at point A where liquid refrigerant leaving the refrigeration condenser at a temperature higher than that of the refrigeration condenser cooling water and at high pressure passes to the constant enthalpy throttle valve where its pressure is reduced. The pressure and temperature of the liquid downstream of the valve are naturally less than on the high pressure side. The expansion is adiabatic; some liquid flashes into vapor cooling the remainder of the refrigerant on the low pressure side at point B. The partly vaporized refrigerant enters the shell of the chiller, where the remainder is vaporized isothermally at low temperature by the water being chilled as it passes through the tubes. The vapor then passes to the compressor between points C and D where it is recompressed to the high pressure and temperature such that it can be recondensed with available cooling water. The step controller of the compressor in the refrigeration cycle is the means to attain the appropriate exit water temperature from the chiller to pressure control device.

It may be necessary to chill seal water, as outlined in entering the TSLRVP to maintain the seal water at a sufficiently low temperature to eliminate seal water flushing throughout operation of the TSLRVP as taught by Bernard in U.S. Pat. No. 4,359,313. This can be achieved by sharing the chiller associated with the pressure control system or by adding a new chiller to the TSLRVP.

The mode of operation of the pressure control system depends on whether it is installed in a power plant with an in-service condenser, or with a new condenser. For in-service condensers, the optimum minimum pressure of the pressure control device falls between upper and lower bounds which are defined, respectively, as MIN [P1, $P_{sat}$ (T1+4.2° C.)] and MAX [3377 pascal, $P_{tur}$, P2]. MIN[,] and MAX [, ,] represent the minimum function and the maximum function for selecting the smallest and the largest values of the variables in the brackets. P1 and T1 are measured pressure and temperature of the steam and air mixture at the entrance to the pressure control device; $P_{sat}$ is the saturation pressure corresponding to T1+4.2° C.; P2 is the pressure of the steam and air mixture leaving the pressure control device; and $P_{tur}$ is the exit design pressure of the low pressure turbine. The Heat Exchange Institute has recommended 4.2° C. (7.5° F.) to account for subcooling as is well known. Since the internal design of condenser tube bundles differs substantially with manufacturers, it is not possible to recommend a single optimum minimum pressure for all in-service condensers. However, the optimum minimum pressure of the pressure control device can be determined by on-site tests with a systematic incremental decreasing of operating pressure starting with the upper bound defined above and going to the lower bound. During the process, each targeted operating pressure level of the pressure control device, P0, can be reached by adjusting the condensation rate in the pressure control device. The rotameter reading of total air leakage and the power output are recorded for each targeted operating pressure level. The rotameter readings provide a correlation between the subcooling of the steam and air mixture and the efficiency of the air removal system. The optimum minimum pressure of the pressure control device is the pressure that corresponds to the maximum power output.

For new condensers with a new design, the optimum minimum pressure is the pressure to be kept as close as possible to the lower bound defined as MAX[3377 pascal, $P_{tur}$]. During the design stage, the scientific method (i.e. calculations of detailed velocity, pressure, temperature, air concentration and condensation rate distributions) should be used with the pressure starting at the lower bound and being incrementally increased up to slightly below the condenser design pressure to represent the boundary condition associated with the air removal system. Based on these calculations the optimum minimum pressure of the pressure control device is selected to ensure (1) that the air offtake pipe is indeed located in the lowest pressure zone in the shell side, and (2) that subcooling is maintained for efficient air removal. A new condensers with an old design is treated as an in-service condenser.

As mentioned before, the operating pressure of pressure control device depends on the condensation rate, which is controlled by either flow rate or temperature of water, or both, leaving the chiller and flowing to the pressure control device. The automatic control of either flow rate or temperature of water, or both, leaving the chiller is described below:

(1) Controlling of the flow rate of the cold water loop with a given temperature of water leaving the chiller to the pressure control device.

The flow rate in the cold water loop as shown in FIG. 3 is directly proportional to the operating speed of variable speed pump 31 . The operating pump speed is automatically controlled in response to the targeted operating pressure of the pressure control device, P0, and the measured pressure P2 at pressure sensor 54 of the steam and air mixture leaving the pressure control device to TSLRVP. P0 is the set point pressure and is known a priori. Controller 1A 50 is designed to yield the desired pump speed or flow rate of the cold water loop such that if P2>P0, the pump speed is increased, and if P2<P0, the pump speed is decreased.

(2) Controlling of the temperature of water leaving the chiller to the pressure control device with a given flow rate of the cold water loop.

The temperature of water leaving the chiller T3 at temperature sensor 55, is automatically controlled in response to the targeted operating pressure of the pressure control device, P0, and the measured pressure P2 at pressure sensor 54 of the steam and air mixture leaving the pressure control device to TSLRVP. P0 is the set point pressure and is known a priori. Controller 1B 51 is designed to yield the desired temperature of water leaving the chiller T3 at temperature sensor such that if P2>P0, T3 is decreased; and if P2<P0, T3 is increased. With the T3 decreasing and increasing, controller 2 52 is designed to activate and deactivate, respectively, the microswitches of the step controller of the compressor 39. However, the extent of activating and deactivating of the microswitches of the step controller is controlled in response to the measured temperatures T3 and T4 by temperature sensors 55 and 56, respectively.

(3) Controlling both flow rate and temperature of water leaving the chiller to the pressure control device.

To exercise of control option 3, it is necessary to know a desirable range of flow rates in the cold water loop. This control option can be accomplished by an iterative process. In each iteration, first the flow rate is changed by means of controller 1A 50, followed by changing the temperature leaving the chiller T3 by means of a combination of Controller 1B 51 and controller 2 52. Controller 1B and controller 2 work together to adjust the step controller of the compressor. Controlling both flow rate and temperature of water leaving the chiller provides the benefits of allowing for optimization of performance parameters, such as response time, and of reducing the cost of the pressure control system.

I claim:

1. A pressure control system in an air removal system of a shell and tube condenser in a power plant for maintaining optimum minimums pressure at the entry of a two-stage liquid ring vacuum pump in the air removal system comprising:

a pressure control device for condensing part of the steam in a mixture of steam and air from the condenser passing through an air offtake pipe, the steam and air mixture leaving the pressure control device to enter a portion of the air offtake pipe downstream of the pressure control device that leads to the two-stage liquid ring vacuum pump;

a chiller for cooling water used in the pressure control device to condense steam in the mixture of steam and air;

a loop with flow of cold water circulating through the chiller, the pressure control device, the loop also containing a variable speed pump to adjust flow rate in the cold water loop;

a drain line with a check valve that removes condensate from the pressure control device;

temperature sensors in the cold water loop and temperature and pressure sensors in the air offtake pipe upstream and downstream of the pressure control device; and means to use temperature and pressure readings of the temperature sensors and the pressure sensors to adjust condensation rate in the pressure control device.

2. A pressure control system as set forth in claim 1, wherein the means to adjust condensation rate in the pressure control device is a controller that varies the speed of the variable speed pump.

3. A pressure control system as set forth in claim 1 wherein the means to adjust condensation rate in the pressure control device is a controller that varies temperature of water leaving the chiller in the cold water loop.

4. A pressure control system as set forth in claim 2 further comprising a controller that varies temperature of water leaving in the chiller in the cold water loop.

5. A pressure control system as set forth in claim 3 wherein the chiller uses a refrigeration loop with a compressor with a step controller for adjusting the amount of heat of the water being removed passing through the chiller, a refrigeration condenser, and a throttle valve.

6. A pressure control system as set forth in claim 5 wherein the means to adjust the condensation rate in the pressure control device is additional controllers to adjust the step controller in the compressor of the chiller.

7. A pressure control system as set forth in claim 6 further comprising a controller that varies the speed of the variable-speed pump.

* * * * *

UNITED STATES PATENT AND TRADEMARK OFFICE

CERTIFICATE OF CORRECTION

PATENT NO. : 6,128,901
DATED : October 10, 2000
INVENTOR(S) : William T. Sha

It is certified that error appears in the above-identified patent and that said Letters Patent is hereby corrected as shown below:

Drawings,
Sheet 3, Fig. 3,
Reference number "52" should read -- 2 52 --; add -- T4 -- in controller 2 52;
Reference number "55" should read -- T3 55 --; and add a line directly connecting controller 2 52 with compressor with step controller 39.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*